US009315246B2

(12) United States Patent
Friedman

(10) Patent No.: US 9,315,246 B2
(45) **Date of Patent: *Apr. 19, 2016**

(54) SELF-CLEANSING RETRACTABLE HANDLE ASSEMBLY FOR WATER CRAFT

(71) Applicant: Matthew J. Friedman, Encinitas, CA (US)

(72) Inventor: Matthew J. Friedman, Encinitas, CA (US)

( * ) Notice: Subject to any disclaimer, the term of this patent is extended or adjusted under 35 U.S.C. 154(b) by 72 days.

This patent is subject to a terminal disclaimer.

(21) Appl. No.: 14/306,881

(22) Filed: Jun. 17, 2014

(65) Prior Publication Data

US 2014/0290010 A1 Oct. 2, 2014

Related U.S. Application Data

(63) Continuation of application No. 13/275,790, filed on Oct. 18, 2011, now Pat. No. 8,777,683.

(60) Provisional application No. 61/444,065, filed on Feb. 17, 2011, provisional application No. 61/468,363, filed on Mar. 28, 2011.

(51) Int. Cl.

| | |
|---|---|
| ***A63C 5/03*** | (2006.01) |
| ***B63B 35/81*** | (2006.01) |
| ***B63B 35/79*** | (2006.01) |

(52) U.S. Cl.

CPC ..... *B63B 35/7933* (2013.01); *B63B 35/7946* (2013.01); *Y10T 16/473* (2015.01)

(58) Field of Classification Search

CPC ..... B63B 2035/7903; B63B 35/7906; B63B 35/81; B63B 35/7909; B63B 35/7926; B63B 35/7959; B63B 35/7973; B63B 2035/7986; B63B 35/7963; B63B 35/7933; B62B 15/00; B63H 9/0642

USPC ..... 441/65, 74; 114/39.15

See application file for complete search history.

(56) References Cited

U.S. PATENT DOCUMENTS

| | | | | |
|---|---|---|---|---|
| 4,805,546 | A * | 2/1989 | Geller | B63B 35/7926 114/127 |
| 5,038,698 | A * | 8/1991 | Winner | B63B 35/7926 114/39.15 |
| 5,129,344 | A * | 7/1992 | Ono | B63B 35/7926 114/127 |
| 5,148,761 | A * | 9/1992 | Winner | B63B 35/7926 114/39.15 |

* cited by examiner

*Primary Examiner* — Daniel V Venne

(74) *Attorney, Agent, or Firm* — Charmasson, Buchaca & Leach, LLP

(57) ABSTRACT

A concealably retractable handle is ensconced into the core or hull of a recreational or utilitarian floatation structure such as a canoe, kayak, surfboard, sailboard, paddle board or the like, where it lies below the outer surface without interfering with normal use of the structure. The handle can be conveniently extracted and secured in an operational position to facilitate handling and carrying the structure or securing it the a vehicle. The housing of the handle is bonded into the body of the floatation device through a padding sleeve which absorbs stress forces that could damage the solidity of the bond and the integrity of the whole structure. During handle retraction structures encourage agitation of water located inside the housing to facilitate water and debris evacuation.

16 Claims, 6 Drawing Sheets

SELF-CLEANSING RETRACTABLE HANDLE ASSEMBLY FOR WATER CRAFT

PRIOR APPLICATION

This application is a continuation of U.S. patent application Ser. No. 13/275,790 filed Oct. 18, 2011, now U.S. Pat. No. 8,777,683, issued Jul. 15, 2014 which claims the benefit of U.S. Provisional Application Ser. No. 61/394,340 filed Oct. 18, 2010, U.S. Provisional Application Ser. No. 61/444,065 filed Feb. 17, 2011, and U.S. Provisional Application 61/468,363 filed Mar. 28, 2011.

FIELD OF THE INVENTION

The invention relates to accessories for use with aquatic floatation devices, and more particularly to a retractable handle assembly for mounting flush within an aquatic floatation device such as a surfboard, paddle board, wind-surfboard, and the like.

BACKGROUND

Surfboards have been widely available for many years, and more recently sailboards, paddle boards and related aquatic floatation devices have become increasingly popular. Surfboards exist in various sizes and shapes; for example, shortboards and longboards. Longboards are typically greater than 2.4 meters (8 feet) in length measured from nose to tail. In contrast, shortboards are typically less than 1.8 meters (6 feet) in length.

Because the center of gravity of a standing person above a paddle board is significantly expanded above the water line, paddle boards typically require an increase in one or more of length, width, and thickness of the board. The increased size results in at least two problems.

First, a wide board, especially one having a width greater than 50 centimeters (20 inches), is difficult to carry. Typical surfboards are usually carried underarm. This becomes impossible with large boards. One can be injured by overextending one's arm in an attempt to carry an oversized board.

Second, the added mass from increased bulk of oversized boards presents additional problems. For example, these boards often become too heavy for a person to carry under the arm, or even above the head when using two hands each grasping an opposite rail. Additionally, the sea often creates strong winds which are beneficial to sailing and other aquatic activities; however a rider carrying an oversized board can become injured from winds blowing against the board if the individual does not having a strong grasp of the board.

Without an appropriate grip of the board, the board can slip from the arm and become damaged from hitting the ground. Additionally, wind can force the board out from a weak grip and can cause damage to the board or injury to the person carrying the board.

There have been many attempts to improve the function of carrying oversized aquatic floatation devices such as longboards and paddle boards.

For example, Chock, Jr., U.S. Patent Publication No. 2010/0187274 discloses a wearable rack for carrying a stand-up surfboard, also referred to herein as a paddle board. One problem with this design includes having to leave the carrier at the beach when paddling out on the board. The carrier can therefore become easily picked up by the rise of tides and drift away, or be stolen. Additionally, if a rider were to take the carrier into the surf, the carrier might easily be lost or even become a hazard should the carry carrier strap wrap around a riders body. Whether left on shore or taken into the surf, the carrier described in this application is problematic for at least the reasons set forth above.

Another attempt to improve carrying of oversized surf boards includes the embodiments disclosed in Conroy, U.S. Pat. No. 5,823,551. This reference discloses a lightweight carrier made of PVC and foam, the carrier attaches to the board and a second attachment includes a handle for strapping on the board such that a user can pull the strapped handle and wheel the board to the surf. One problem with this carrier is that the wheels would be difficult to move through the sand at a beach. Additionally, there are several attachment components which can each become lost if left at the beach while the rider paddles out. Additionally, it would be inconvenient to haul the carrier into the surf.

It is also difficult to secure a recreational floatation board on top or against the side of a vehicle, or on a luggage rack due to the lack of grasping structure.

SUMMARY

The principal and secondary objects of the invention are to provide an improved water craft carrying mechanism. These and other objects are achieved by a recreational floatation board having a retracting carrying handle packaged into a housing buried into a cavity formed into the board with an opening lying substantially flush with the top surface. The disclosed carrying handle may also be incorporated into other types of floatation devices such as canoes, kayaks and boat hulls.

DESCRIPTION OF THE PREFERRED EMBODIMENTS

Figure 1:
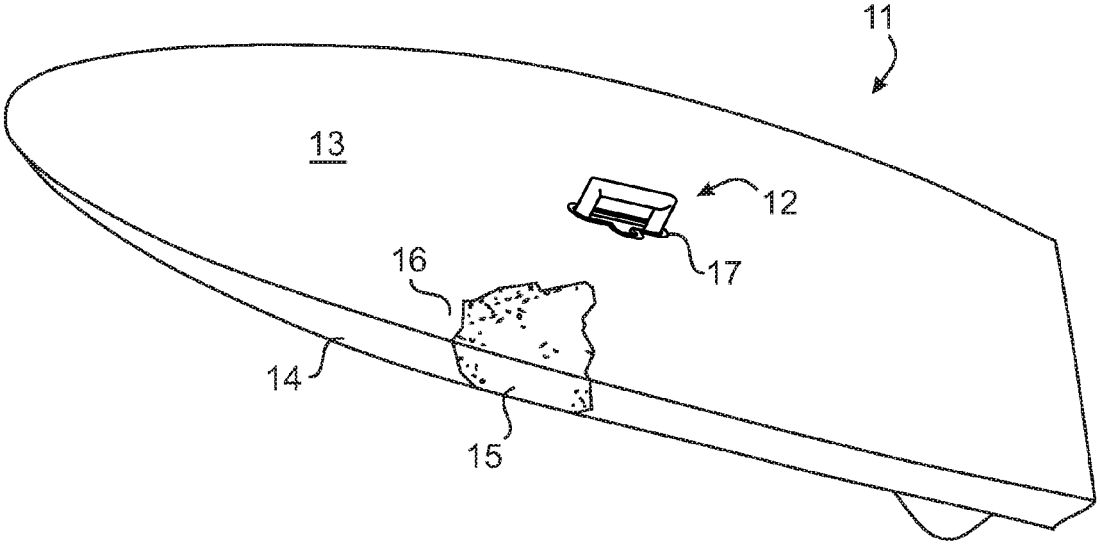
FIG. 1 is a perspective view of a floatation board equipped with a retractable carrying handle assembly according to an embodiment of the invention.
Figure 2:
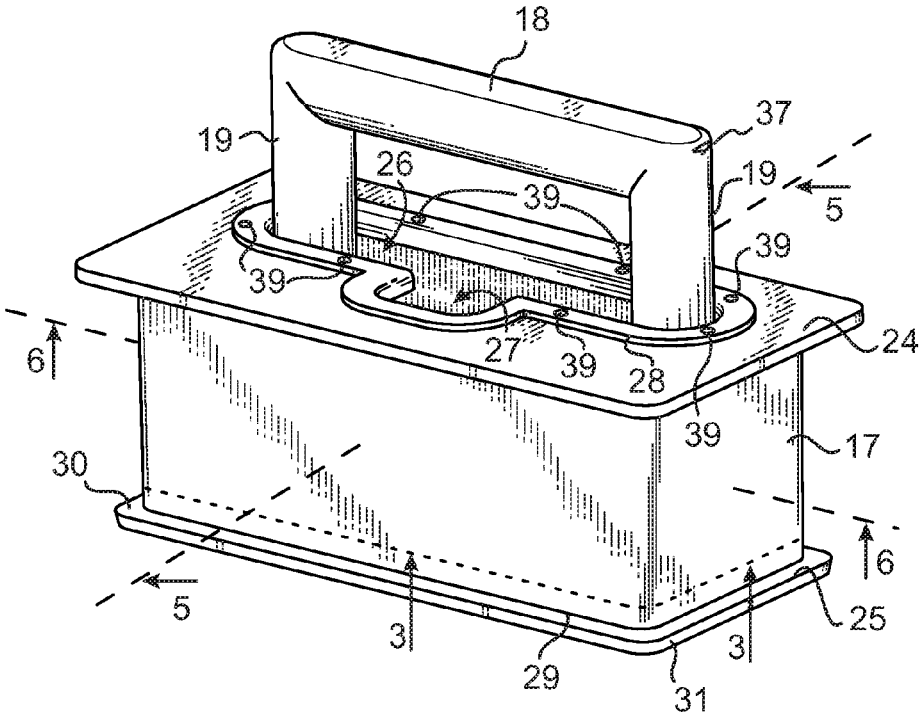
FIG. 2 is a front, top and side perspective view of the handle assembly and housing.
Figure 3:
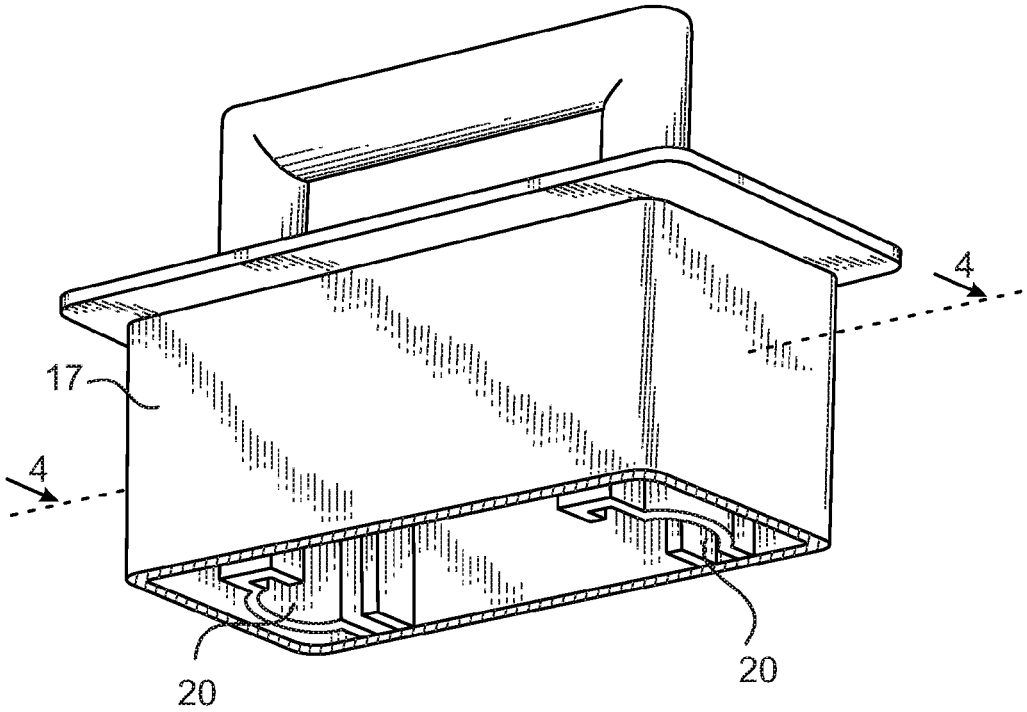
FIG. 3 is a front, bottom and side perspective view thereof as a partial cutaway along dotted line 3-3 of FIG. 3.

Referring now to the drawing, there is shown in FIG. 1 a recreational floatation board, such as a paddle board 11 equipped with a retractable carrying handle assembly 12. The board has a substantially planar load-bearing top surface 13 and a relatively shallow hull 14. The board consists essentially of a core made of a slab of buoyant low density (about one pound per cubic foot), rigid foam material 15 covered by a durable rigid skin 16 made from composite material such as fiberglass-resin composite sheets. The handle assembly is packaged in a housing 17 ensconced in a cavity cut into a median section of the slab. The housing is approximately 16.5 centimeters (6.5 inches) long, 7.5 centimeters (3 inches) wide and 6 centimeters (2.4 inches) deep. The handle assembly can be completely pushed into the housing which has an opening substantially flush with the top surface of the board.

Figure 4:
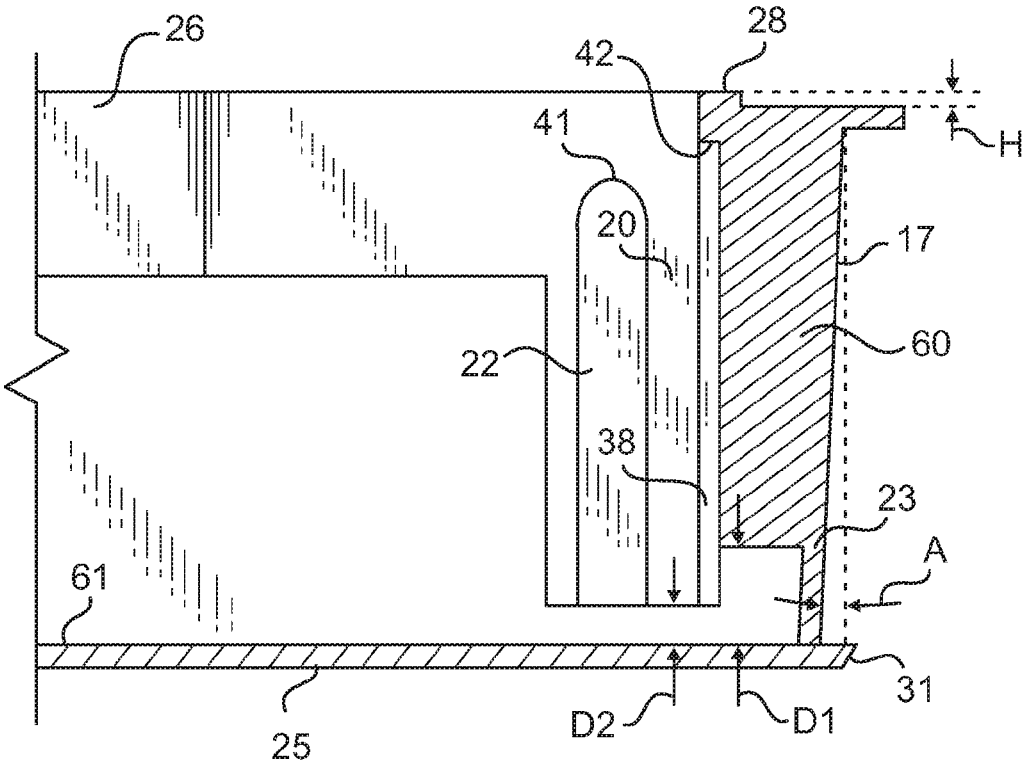
FIG. 4 is a half cross-sectional view taken along line 4-4 of FIG. 3.
Figure 5:
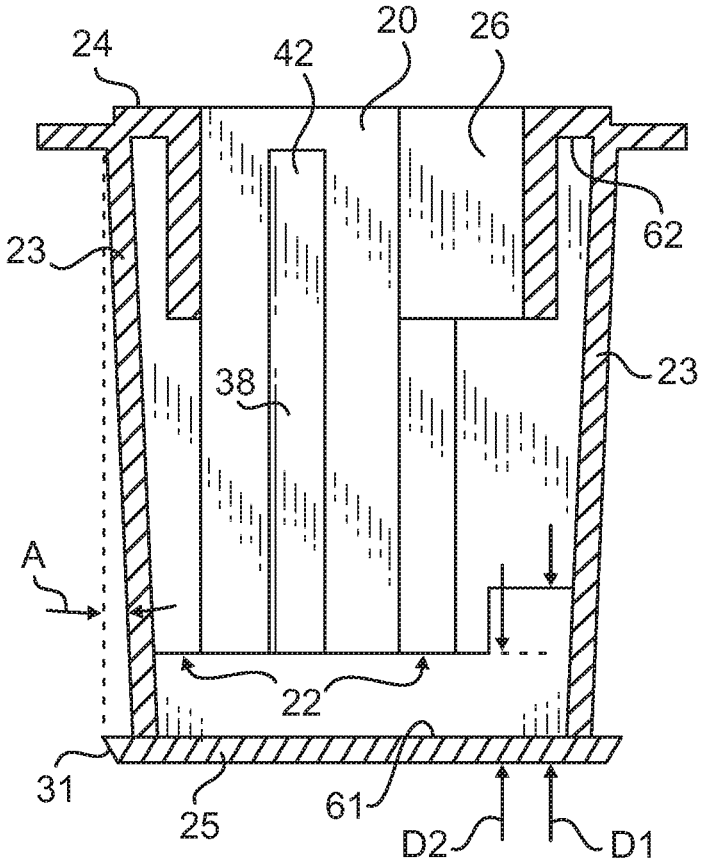
FIG. 5 is a cross-sectional view taken along line 5-5 of FIG. 2.
Figure 6:
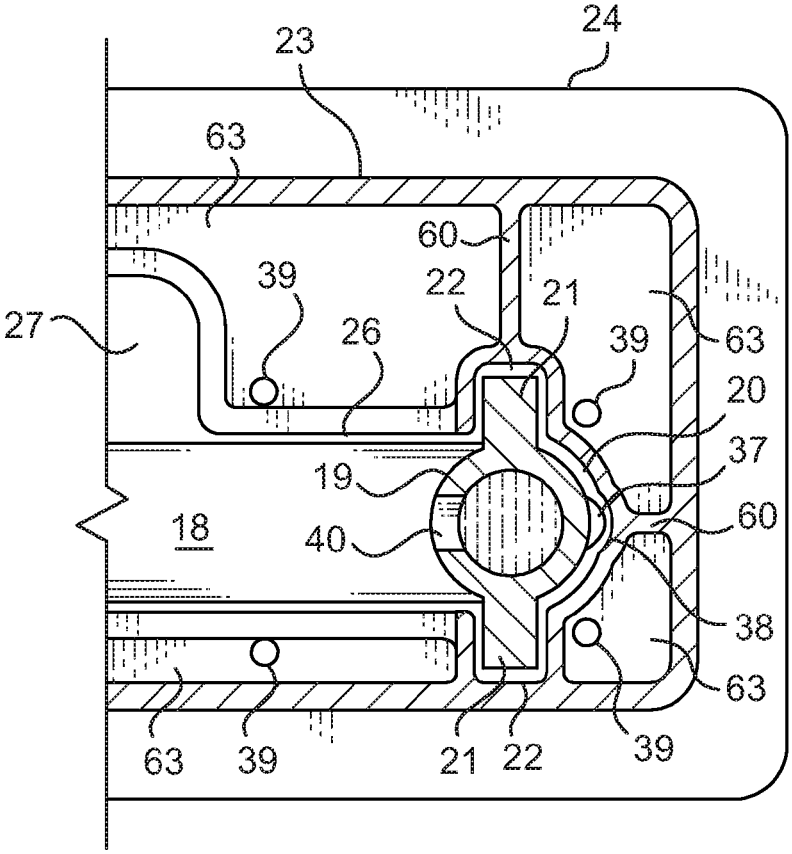
FIG. 6 is a half cross-sectional view taken along line 6-6 of FIG. 2.
Figure 7:
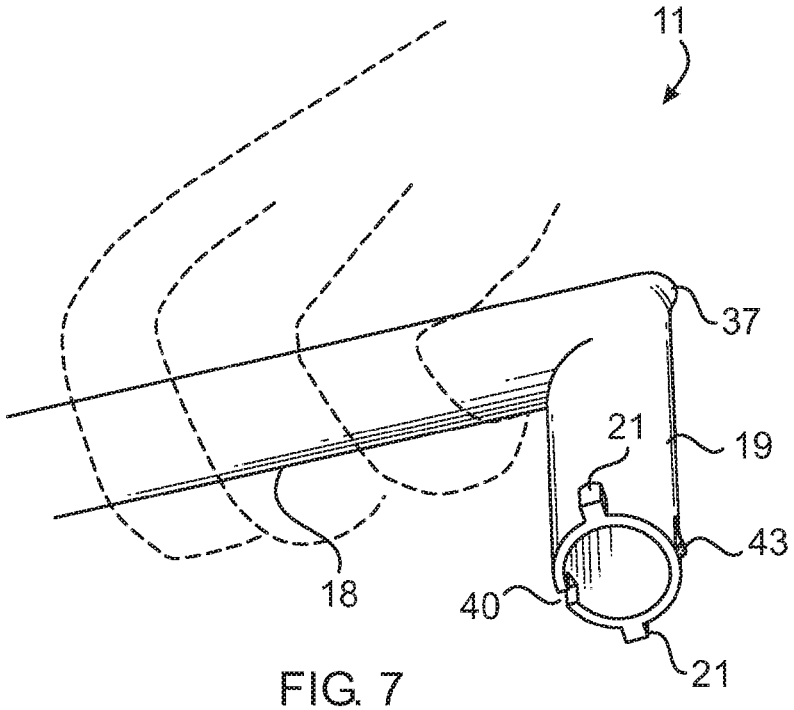
FIG. 7 is a front, bottom and side half perspective view of the handle assembly.

As illustrated in FIG. 7, the handle assembly comprises an oblong member 18 of approximately 12.5 centimeters (5 inches) in length shaped and dimensioned to be comfortably grasped by a hand (partially shown in dashed lines). A shaft 19 extends radially from each opposite end of the member about 6.5 centimeters (2.5 inches) into a well 20 of a 2 centimeters (0.75 inch) diameter formed in the housing where its extremity is moveably secured to it by tabs 21 having rounded top edges 41 slidingly riding into a pair of slotted, closed-ended channels 22 more specifically shown in FIGS. 4-6. Accordingly, the graspable member 18 of the handle assembly may be pulled out of the housing roughly up to the height of the shaft until the tabs 21 reach the rounded top ends 41 of the channels 22. The commensurately rounded top edges of the tabs and top ends of the channels cause the handle assembly to be self-centered and more firmly held in place in the fully extended position.

Figure 9:
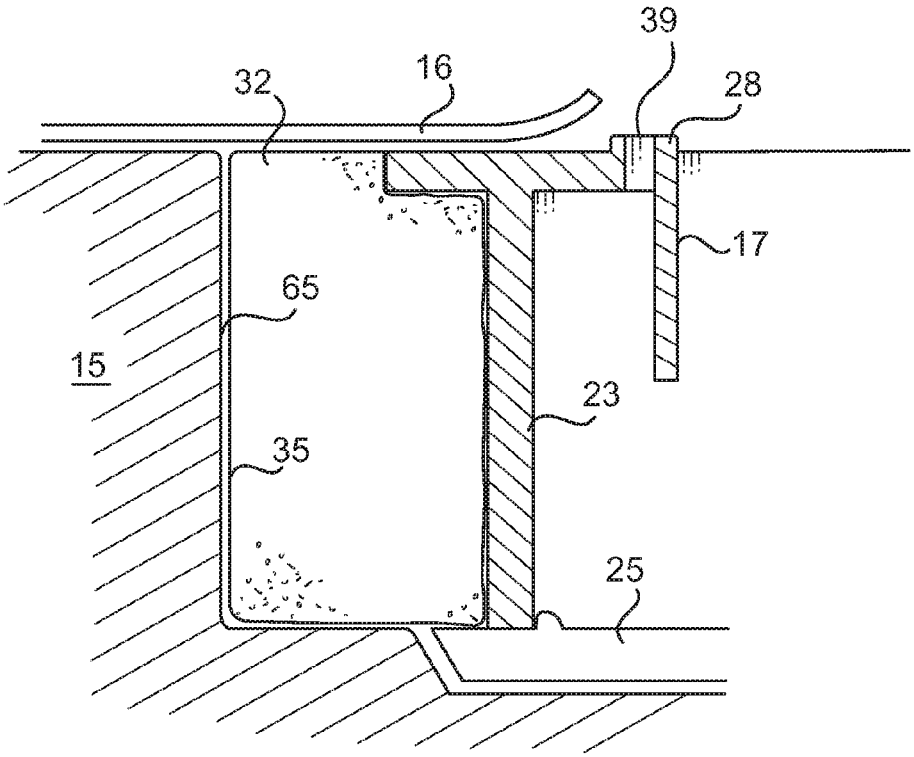
FIG. 9 is a partial cross-sectional view of the junction of the housing, housing sleeve and skin about the edge of the handle assembly; and, FIG. 10 is a front, top and side perspective view of an alternate embodiment of the handle assembly and housing.

The housing 17 includes a quadrangular peripheral wall 23, a roof 24, and a bottom plate 25. The roof has an oblong aperture 26 through which the oblong member can be extracted. The manual extraction is facilitated by a finger-inserting notch 27 in the periphery of the aperture. A bulging bead 28 is formed on the rim of the aperture and notch. The bead extends to a height H commensurate with the thickness of the skin 16. During the manufacture of the board, the housing is buried into a commensurately shaped cavity in the slab to the top of the roof, and the skin section covering the top surface is extended over the roof to the edge of the bead as illustrated in FIG. 9. The cavity can be molded into the slab or cut from a pre-molded slab. The top surface of the roof is preferably etched to facilitate adhesion with the skin A skin bond avoidance mask having a peripheral shape commensurate with the peripheral shape of the bead can be adhered to the top roof surface during manufacture so that the skin can be conveniently formed over the bead. Thereafter, the skin over the bead can be removed along with the mask.

The bottom plate 25 is bonded or snap-fitted, sonic welded or otherwise secured to the lower edge 29 of the wall 23 after the handle assembly has been inserted through the base of the housing. It is important to note that the handle assembly can be made symmetrically so that it can be inserted in a first orientation or rotated 180 degrees about a central axis parallel with an elongation axis of a shaft 19 and inserted. Such universality can reduce assembly costs. The wall tapers inwardly toward the bottom plate at dwell angle A of approximately 0.25 to 1 degree, and more preferably about 0.5 degree in order to facilitate extraction of the housing from its mold during manufacture. The bottom plate extends peripherally beyond the lower edge of the wall into a narrow ledge 30 which can carry an amount of adhesive for bonding the housing to the slab and can oppose extraction of the housing from the cavity. The edge 31 of the bottom plate can taper inwardly from the ledge to enhance penetration movement but resist extraction movement of the housing with respect to the slab.

Figure 8:
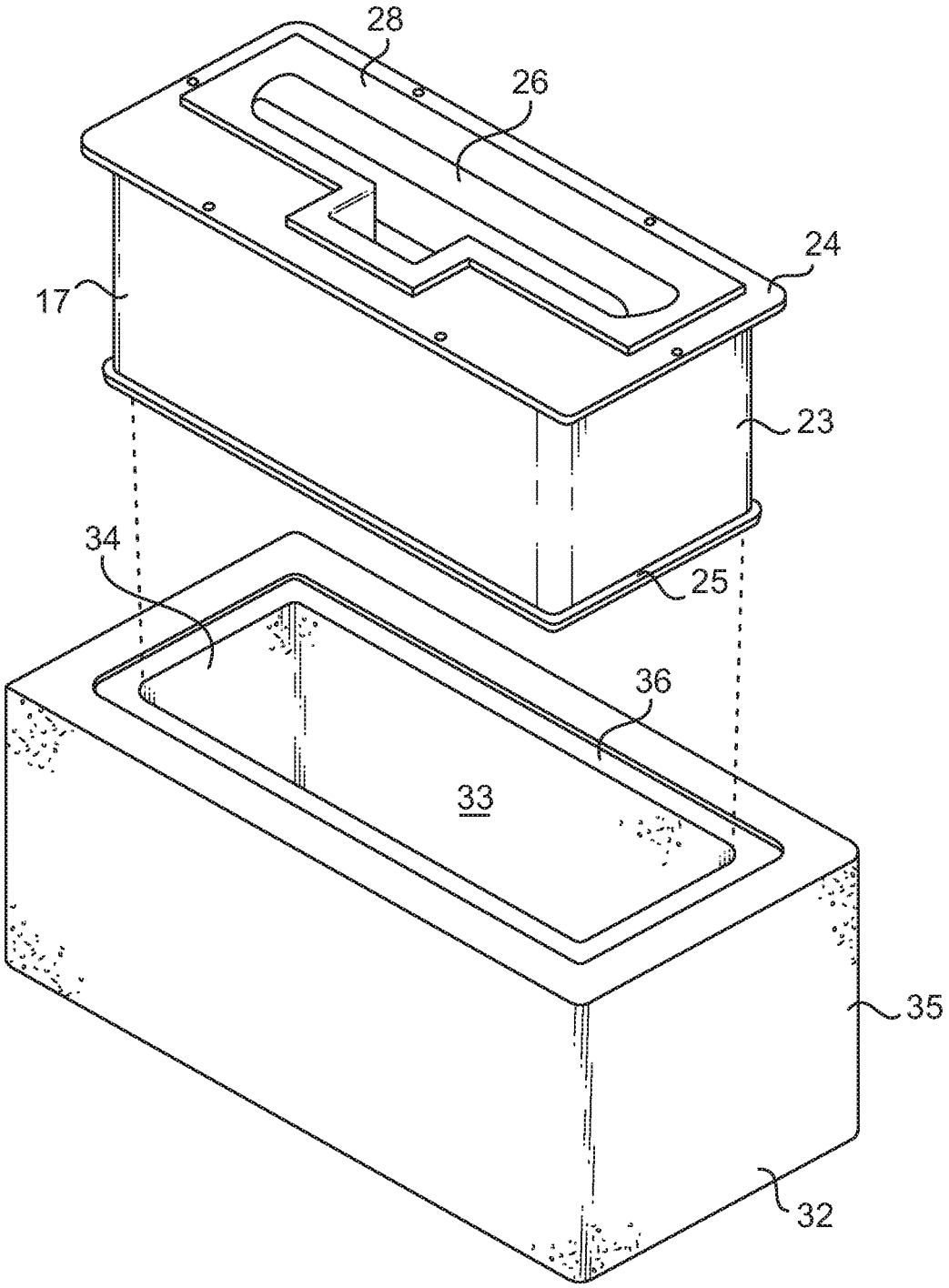
FIG. 8 is a front, top and side perspective view of the housing sleeve.

As illustrated in FIG. 8, a sleeve 32 made of a resiliently compressible material such as high density foam (about 6 to 8 pounds per cubic foot) or rubber and having an inside space 33 commensurate with the housing has its inner surface 34 bonded to the wall 23 and its outer surface 35 bonded to a cavity wall 65 of the board slab 15. A rim groove 36 at the top of the sleeve is dimensioned to receive the outer edge of the housing roof. The sleeve has walls about 2.5 centimeters (1 inch) thick, and is intended to absorb torsional deformations of the whole carrying structure during rough handling and to accommodate thermal expansions without affecting the bonding with the foam slab.

Two radial nibs 37, 43 positioned at opposite ends of each shaft project into a small track 38 in the well 20 and frictionally contact an upper shelf 42 when the grasping member is either extracted completely from of pushed down into its well, and acts as immobilizing detents. The former action can also be achieved by slightly tapering the channels downwardly and outwardly to cause some friction against the wells and releasably immobilize the handle assembly in the extracted position.

The roof 24 is pierced with a series of bores 39 to facilitate evacuation of water, sand and debris that may accumulate inside the housing. In order to generate turbulence and maximize the expulsion of sand and debris when the handle assembly is pushed back into the housing, the shafts are preferably tubular and have a notched portion 40 at their base. During retraction of the handle, ambient water can be forced through notched portions to form a water jet to agitate the ambient water and thus suspend the sand and debris for evacuation. The notches in both shafts are oriented to oppose one another in order to maximize turbulence where the jets meet one another.

In addition, the wells 20 are structurally reinforced within the housing by a plural number of spaced apart gussets 60 connecting the wells to the peripheral wall 23 of the housing 17 to form a number of adjacent chambers 63 surrounding the area of the aperture 26. The gussets 60 can terminate a distance D1 above the bottom plate 25, and the wells 20 can terminate a distance D2 above the bottom plate to create an expensive open space extending fully across the inner top surface 61 of the bottom plate to the inner surfaces of the peripheral wall 23. The distance D2 can be smaller than D1 to provide a bearing surface to the shafts during their entire range of motion between the extended and retracted positions. In this way, agitation can spread across the entire inner top surface 61 of the bottom plate to maintain suspension of debris until drained out. Repeated extension and retraction of the handle shafts 19 along the wells 20 cause a self-cleansing action for the interior of the housing. It's important to note that the gussets 60 can extend vertically to attach to the underside 62 of the roof 24 for added strength and stability, and to avoid interior voids which can be more costly to manufacture. At least one of the bores 39 is provided for fluid communication therethrough between each chamber 63 and the top of the roof 24 to facilitate drainage and air intake for each chamber.

Figure 10:
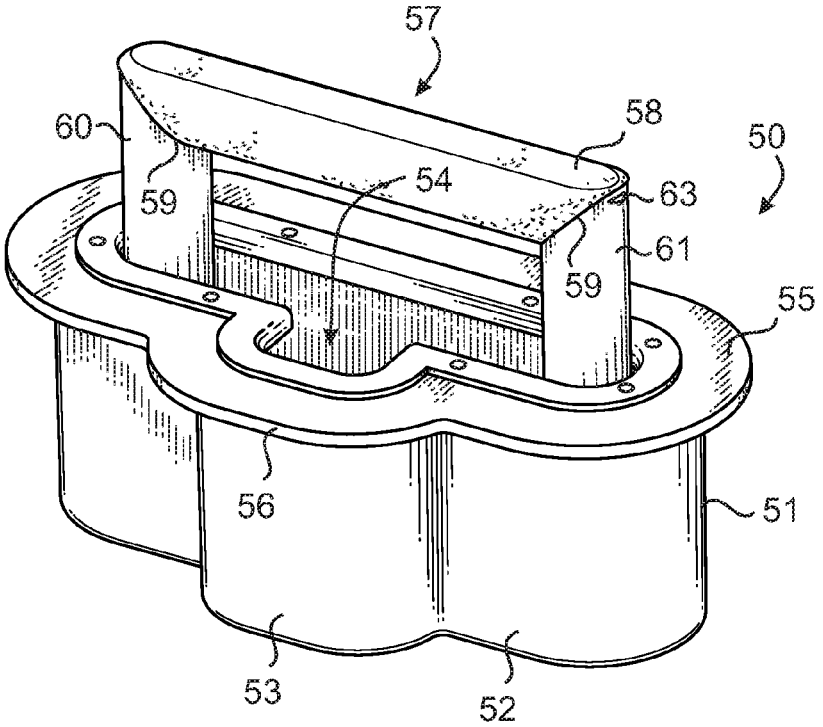

FIG. 10 shows an alternate embodiment for the handle assembly 50 having a housing 51 shaped to have a front wall 52 having a central salient 53 around the finger notch 54. The top roof 55 has a similar geometry having a front salient 56 so that its periphery extends a distance beyond the top edge of the walls to prove a minimum adequate surface for bonding of skin of the board.

In addition, and optionally, a portion of the outer surface of the oblong member 57 of the handle can be covered with a layer 58 of durable, resiliently compressible material such as a synthetic rubber-type material. The layer can be secondarily molded upon the member after the rigid part of the handle has been molded. The layer terminates at angled edges 59 so as not to cover the outer surface of the shafts 60, 61 extending orthogonally downward from the opposite ends of the oblong member. This also allows the radial locking nibs 63 to remain unimpeded and thus free to detentedly engage the shelf in the housing track. The resilient material layer 58 allows for more comfortable extended duration grasping by a user while not interfering with the other functions of the retractable handle device.

The instant invention thus provides a convenient implement for holding and carrying a recreational or utilitarian floatation structure such as a canoe, kayak, surfboard, sailboard or paddle board. It can also be used for conveniently and securely fastening the structure to an automobile rack using straps, or bicycle rack using a cable or chain to avoid theft. The grasping handle is completely contained in the housing buried under the top surface of the structure, leaving no protruding part that could interfere with its normal use or operation. The grasping handle can be released from its secured stowed position and extracted into a stable functional position above the surface of the structure with an easy pull of a finger.

While the preferred embodiment of the invention has been disclosed, modifications may be made and other embodiment may be devised without departing from the spirit of the invention and the scope of the appended claims.

The invention claimed is:

1. A watercraft having a substantially planar load-carrying top surface having a cavity and a skin of a given thickness covering said substantially planar load-carrying top surface, an improvement which comprises a housed handle assembly which comprises:

a housing inserted through said cavity in said substantially planar load-carrying top surface, said housing comprising:

an aperture flush with said substantially planar load-carrying top surface;

a finger-insert notch in a periphery of said aperture;

a peripheral wall having a lower edge; and a flat roof having said aperture and a marginal flange portion projecting outwardly beyond said peripheral wall; and a handle assembly retractably ensconced into said housing;

wherein said handle assembly comprises:

a hand-graspable, oblong member; and at least one shaft extending orthogonally from said member and being moveably secured into said housing;

wherein two of said at least one shaft extend orthogonally from opposite end regions of said member into a pair of commensurate wells formed in said housing;

and wherein at least one of said two of said at least one shaft comprises at least one radial tab projecting into a slotted, closed-ended channel cut axially along one of said wells.

2. The watercraft of claim 1, wherein said housing further comprises a bottom plate bonded to said lower edge and wherein at least one of said wells terminates a distance above said plate.

3. The watercraft of claim 2, an expansive open space extending along an inner top surface of said plate between said wells.

4. The watercraft of claim 1, wherein said handle assembly further comprises:

a layer of resiliently compressible material covering an outer surface portion of said oblong member; said layer does not cover an outer surface portion of said at least one shaft.

5. The watercraft of claim 1, wherein each of said two of said at least one shaft comprises a notched portion at an end opposite said member.

6. The watercraft of claim 1, wherein each of said two of said at least one shaft comprises a hollow tubular portion having at least one radial port and at least one radial nib frictionally projecting into a dent in an inside portion of said well, wherein said port is located at the base of said tubular portion and oriented to expel fluid therethough during a retraction motion.

7. A watercraft having a substantially planar load-carrying top surface having a cavity and a skin of a given thickness covering said substantially planar load-carrying top surface, an improvement which comprises a housed handle assembly which comprises:

a housing inserted through said cavity in said substantially planar load-carrying top surface, said housing comprising:

an aperture flush with said substantially planar load-carrying top surface;

a finger-insert notch in a periphery of said aperture;

a peripheral wall having a lower edge;

a flat roof having said aperture and a marginal flange portion projecting outwardly beyond said peripheral wall;

a bead extending beyond said flat roof around said aperture by an amount substantially commensurate with the thickness of said skin; and, a handle assembly retractably ensconced into said housing.

8. A watercraft having a substantially planar load-carrying top surface having a cavity and a skin of a given thickness covering said substantially planar load-carrying top surface, an improvement which comprises a housed handle assembly which comprises:

a housing inserted through said cavity in said substantially planar load-carrying top surface, said housing comprising:

an aperture flush with said substantially planar load-carrying top surface;

a finger-insert notch in a periphery of said aperture;

a peripheral wall having a lower edge;

a flat roof having said aperture and a marginal flange portion projecting outwardly beyond said peripheral wall;

a bottom plate bonded to said lower edge and extending into a peripheral ledge; and a handle assembly retractably ensconced into said housing.

9. The watercraft of claim 8, wherein the bottom plate has a peripheral edge tapering inwardly from said ledge.

10. The watercraft of claim 8, wherein said peripheral wall tapers inwardly toward said bottom plate.

11. A watercraft having a substantially planar load-carrying top surface having a cavity and a skin of a given thickness covering said substantially planar load-carrying top surface, an improvement which comprises a housed handle assembly which comprises:

a housing inserted through said cavity in said substantially planar load-carrying top surface, said housing comprising:

an aperture flush with said substantially planar load-carrying top surface;

a finger-insert notch in a periphery of said aperture;

a peripheral wall having a lower edge;

a flat roof having said aperture and a marginal flange portion projecting outwardly beyond said peripheral wall; and, a handle assembly retractably ensconced into said housing; and, a sleeve made of a resiliently compressible material and having an inner surface bonded to said housing and an outer surface bonded to a wall of said cavity.

12. A watercraft having a substantially planar load-carrying top surface having a cavity and a skin of a given thickness covering said substantially planar load-carrying top surface, an improvement which comprises a housed handle assembly which comprises:

a housing inserted through said cavity in said substantially planar load-carrying top surface, said housing comprising:

an aperture flush with said substantially planar load-carrying top surface;

a finger-insert notch in a periphery of said aperture;

a peripheral wall having a lower edge;

a flat roof having said aperture and a marginal flange portion projecting outwardly beyond said peripheral wall; and, a handle assembly retractably ensconced into said housing; and, wherein said flat roof has a plurality of bores allowing evacuation of water and debris when the handle assembly is pushed into the housing.

13. A carrying structure, for installation on a watercraft having a substantially planar load-carrying outer surface, which comprises:

a housing inserted in a cavity in said outer surface, said housing comprising:

an aperture flush with said substantially planar load-carrying outer surface;

a peripheral wall having a lower edge; and a flat roof having a aperture and a marginal flange portion projecting outwardly beyond said peripheral wall; and, a handle assembly retractably ensconced into said housing;

wherein said aperture defines a finger-inserting notch to facilitate extraction of the handle assembly from the housing;

wherein said handle assembly comprises:

a hand-graspable, oblong member; and at least one shaft extending orthogonally from said member and being moveably secured into said housing; and, wherein said at least one shaft comprises a notched portion at its base oriented to expel fluid therethough during a retraction motion.

14. A carrying structure, for installation on a watercraft having a substantially planar load-carrying outer surface, which comprises:

a housing inserted in a cavity in said outer surface, said housing comprising:

an aperture flush with said substantially planar load-carrying outer surface;

a peripheral wall having a lower edge; and a flat roof having said aperture and a marginal flange portion projecting outwardly beyond said peripheral wall; and, a handle assembly retractably ensconced into said housing;

wherein said aperture defines a finger-inserting notch to facilitate extraction of the handle assembly from the housing;

wherein said handle assembly comprises:

a hand-graspable, oblong member; and at least one shaft extending orthogonally from said member and being moveably secured into said housing; and, wherein two of said at least one shaft extend from opposite end regions of said member into a pair of commensurate wells formed in said housing, wherein at least one of said two of said at least one shaft comprises at least one radial tab projecting into a slotted, close-ended channel cut axially along one of said wells.

15. The carrying structure of claim 14, wherein said housing further comprises a bottom plate bonded to said lower edge and wherein at least one of said wells terminates a distance above said plate; thereby forming an expansive open space extending along an inner top surface of said plate between said wells.

16. A carrying structure, for installation on a watercraft having a substantially planar load-carrying outer surface, which comprises:

a housing inserted in a cavity in said outer surface, said housing comprising:

an aperture flush with said substantially planar load-carrying outer surface;

a peripheral wall having a lower edge; and a flat roof having said aperture and a marginal flange portion projecting outwardly beyond said peripheral wall; and, a handle assembly retractably ensconced into said housing;

wherein said aperture defines a finger-inserting notch to facilitate extraction of the handle assembly from the housing;

a bead extending beyond said flat roof around said aperture by an amount substantially commensurate with the thickness of said skin;

a bottom plate bonded to said lower edge and extending into a peripheral ledge; and, said peripheral wall tapering inwardly toward said bottom plate.

* * * * *